US012158002B1

(12) United States Patent
Abbas et al.

(10) Patent No.: US 12,158,002 B1
(45) Date of Patent: Dec. 3, 2024

(54) REINFORCED CONCRETE BEAM WITH CORRUGATED WEB REINFORCEMENT PLATE

(71) Applicant: KING SAUD UNIVERSITY, Riyadh (SA)

(72) Inventors: Husain Sayyed Abbas, Riyadh (SA); Mohammed Abdulmagid Almahbashi, Riyadh (SA); Aref Abdullah Abadel, Riyadh (SA); Hussein Mohamed Elsanadedy, Riyadh (SA); Yousef Abdullah Alsalloum, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 18/643,307

(22) Filed: Apr. 23, 2024

(51) Int. Cl.
*E04C 5/06* (2006.01)
*E04C 3/20* (2006.01)

(52) U.S. Cl.
CPC ..... *E04C 5/0645* (2013.01); *E04C 3/205* (2013.01)

(58) Field of Classification Search
CPC ..... E04C 5/0645; E04C 3/205; E04C 2/32; E04C 3/294; E04C 3/293
See application file for complete search history.

(56) References Cited

FOREIGN PATENT DOCUMENTS

| | | | | |
|---|---|---|---|---|
| CN | 101220697 | A | | 7/2008 |
| CN | 103255877 | A | * | 8/2013 |
| CN | 103437501 | A | | 12/2013 |
| CN | 103485477 | A | | 1/2014 |
| CN | 103485478 | A | | 1/2014 |
| CN | 103485479 | A | | 1/2014 |
| CN | 103485483 | A | | 1/2014 |
| CN | 203440994 | U | * | 2/2014 |
| CN | 203805409 | U | | 9/2014 |
| CN | 103498529 | B | | 8/2015 |
| CN | 103255877 | B | | 11/2015 |
| CN | 105019595 | A | | 11/2015 |
| CN | 109113265 | A | | 1/2019 |
| CN | 111794423 | A | | 10/2020 |
| CN | 215406534 | U | * | 1/2022 |
| CN | 115559465 | A | | 1/2023 |
| GB | 587233 | A | | 4/1947 |
| WO | 2017099304 | A1 | | 6/2017 |

OTHER PUBLICATIONS

Translation of CN 203440994 (Year: 2014).*

* cited by examiner

*Primary Examiner* — Andrew J Triggs
(74) *Attorney, Agent, or Firm* — Nath, Goldberg & Meyer; Joshua B. Goldberg

(57) ABSTRACT

The reinforced concrete beam with a corrugated web reinforcement plate uses a web reinforcement plate for reinforcing deep and shear critical concrete beams. A corrugated plate is embedded in the concrete beam, where the corrugated plate has a top edge with a periodic shape and a bottom edge with a periodic shape. The periodic shape of the top edge has a larger wavelength than a wavelength of the periodic shape of the bottom edge. The corrugated plate may have a plurality of openings formed therethrough. A plurality of pipes may be received by, and pass through, at least a portion of the plurality of openings formed through the corrugated plate. Each of the pipes may have a pair of obliquely angled open ends such that the planes defining the open ends are normal to the top and bottom faces of the concrete beam.

13 Claims, 6 Drawing Sheets

REINFORCED CONCRETE BEAM WITH CORRUGATED WEB REINFORCEMENT PLATE

BACKGROUND

Field

The disclosure of the present patent application relates to reinforced concrete beams, and particularly to a corrugated web reinforcement plate for reinforcing deep and shear critical concrete beams.

Description of Related Art

Reinforced concrete (RC) deep beams are structural members having relatively deep sections compared to their span. The American Concrete Institute Building Code Requirements for Structural Concrete ACI 318-19 classifies RC beams as deep beams for which either clear span does not exceed four times the overall depth or the shear span is less than two times the overall member depth. In structural applications, RC deep beams are commonly used as transfer girders, pile caps or foundation walls. The strength of deep beams is usually controlled by shear rather than flexure. Shear failure is catastrophic and can occur without warning. For resisting shear, deep beams are reinforced with web reinforcement, which is typically provided in the form of vertical stirrups and horizontal rebars provided on side faces. Although providing web reinforcement makes the deep beams relatively safe, the ductility against shear failure is limited. Composite beams with embedded rolled steel I-sections have been used, but full composite behavior is difficult to achieve due to the difference in the stiffness of the two elements.

Openings are often required in deep beams for passing utility lines and cutting of an opening (post-construction) affects the shear strength of deep beams, particularly when the opening is close to the support. Although several strengthening schemes have been attempted, none have been successful in restoring the strength of deep beams with large size openings. Thus far, strength has only been restored for small openings. As such, there is a need for better strengthening in RC deep beams.

Structural designers are increasingly concerned about the performance of RC deep and shear critical beams because these beams play a vital role in the overall performance of the building. Although efforts have been made to improve the reinforcement methods and rebar arrangements, there is still a need to address the issues of shear ductility and strengthening of deep and shear critical RC beams with post-construction cut openings of large size. Thus, a reinforced concrete beam with a corrugated web reinforcement plate solving the aforementioned problems is desired.

SUMMARY

The reinforced concrete beam with a corrugated web reinforcement plate uses a web reinforcement plate for reinforcing deep and shear critical concrete beams. A corrugated plate is embedded in the concrete beam, where the corrugated plate has a top edge with a periodic shape and a bottom edge with a periodic shape. The periodic shape of the top edge has a larger wavelength than a wavelength of the periodic shape of the bottom edge. As a non-limiting example, the wavelength of the periodic shape of the bottom edge may be between 25% and 75% of the wavelength of the periodic shape of the top edge. As another non-limiting example, the wavelength of the periodic shape of the bottom edge may be 50% of the wavelength of the periodic shape of the top edge. An amplitude of the periodic shape of the bottom edge may be less than an amplitude of the periodic shape of the top edge.

Alternatively, the periodic shape of the top edge and the periodic shape of the bottom edge may have equal wavelengths. In this non-limiting example, the amplitude of the periodic shape of the bottom edge may be greater than the amplitude of the periodic shape of the top edge.

The corrugated plate may have a plurality of openings formed therethrough. A plurality of pipes may be received by, and pass through, at least a portion of the plurality of openings formed through the corrugated plate. Each of the pipes may have a pair of obliquely angled open ends. Additionally, rebar may also be embedded in the concrete beam along with the corrugated plate.

These and other features of the present subject matter will become readily apparent upon further review of the following specification.

BRIEF DESCRIPTION OF DRAWINGS

Similar reference characters denote corresponding features consistently throughout the attached drawings.

DETAILED DESCRIPTION

Figure 1:
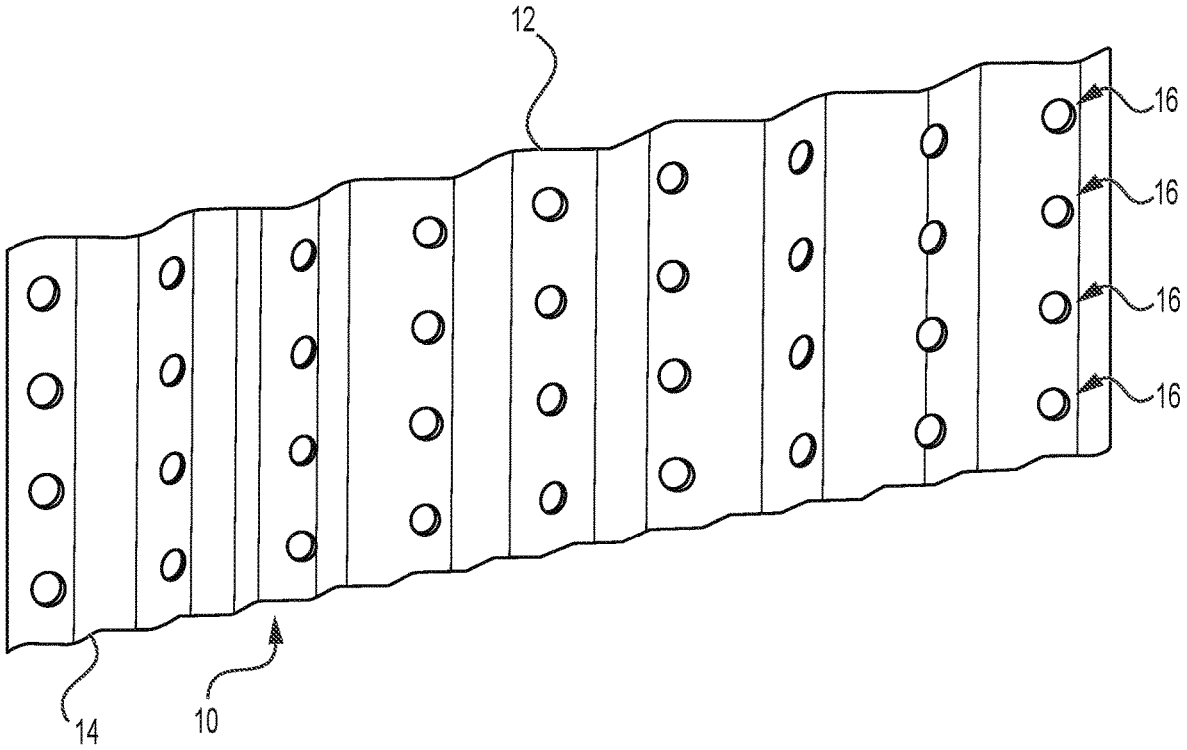
FIG. 1 is a perspective view of a corrugated plate of the reinforced concrete beam with a corrugated web reinforcement plate.
Figure 2A:
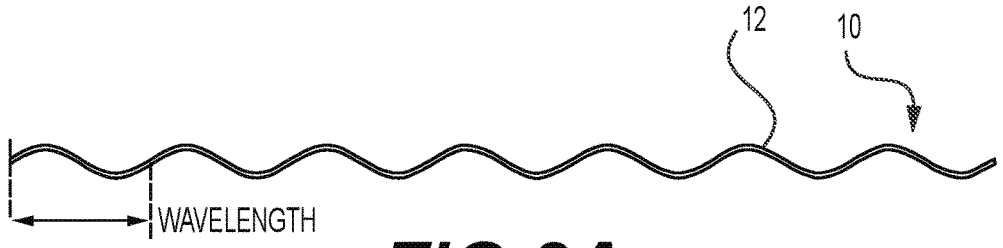
FIG. 2A is a top view of the corrugated plate of FIG. 1.
Figure 2B:
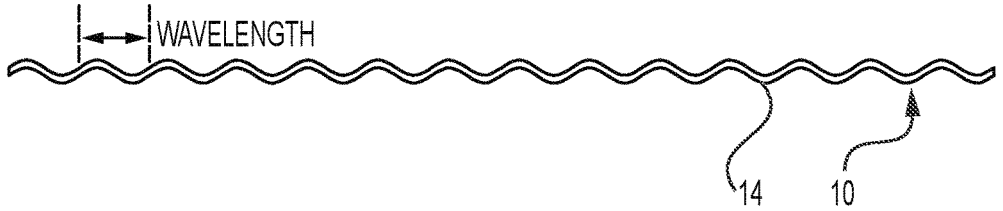
FIG. 2B is a bottom view of the corrugated plate of FIG. 1.

The reinforced concrete (RC) beam with a corrugated web reinforcement plate 100 uses a web reinforcement plate for reinforcing deep and shear critical concrete beams. A corrugated plate 10 is embedded in the concrete beam 102, as will be discussed in greater detail below with regard to FIG. 6. As shown in FIGS. 1, 2A and 2B, the corrugated plate 10 has a top edge 12 with a periodic shape and a bottom edge 14 with a periodic shape. As best seen in FIGS. 2A and 2B, the periodic shape of the top edge 12 has a larger wavelength than a wavelength of the periodic shape of the bottom edge 14. As a non-limiting example, the wavelength of the periodic shape of the bottom edge 14 may be between 25% and 75% of the wavelength of the periodic shape of the top edge 12. As another non-limiting example, the wavelength of the periodic shape of the bottom edge 14 may be 50% of the wavelength of the periodic shape of the top edge 12. The corrugated plate 10 may be made from steel. Although the non-limiting example of FIGS. 1, 2A and 2B show the periodic shapes of top and bottom edges 12, 14 being sinusoidal, it should be understood that any suitable periodic contouring may be used.

Figure 5:
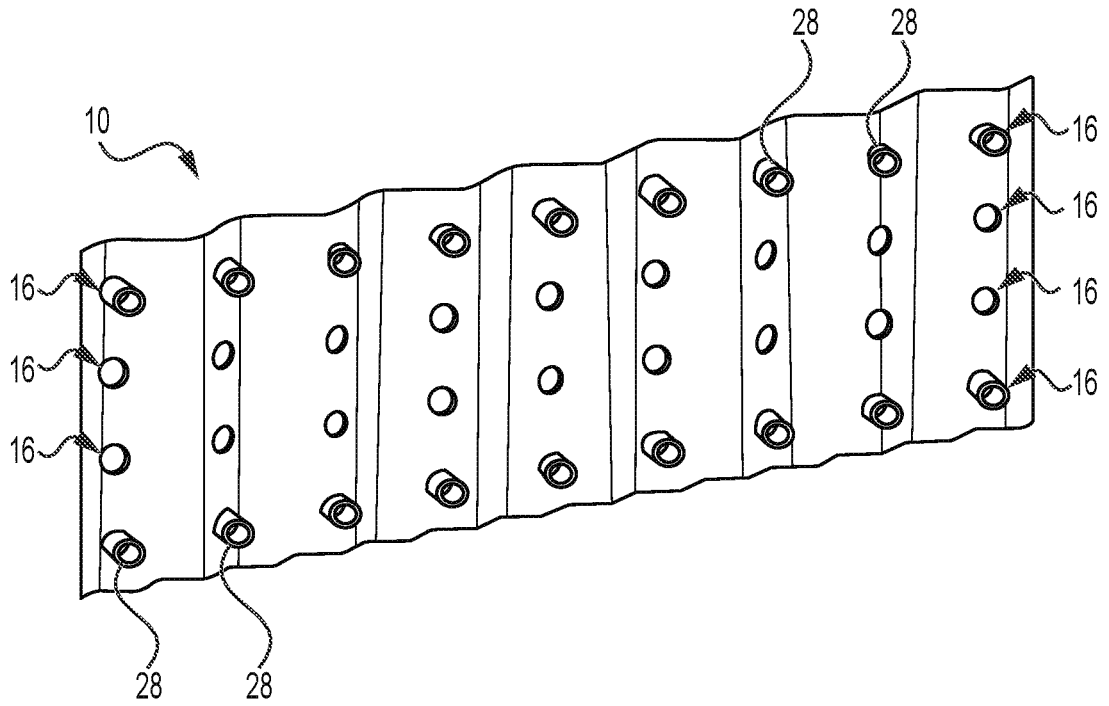
FIG. 5 is a perspective view of the corrugated plate of FIG. 1, shown with a plurality of pipes passing through openings formed through the corrugated plate.
Figure 7:
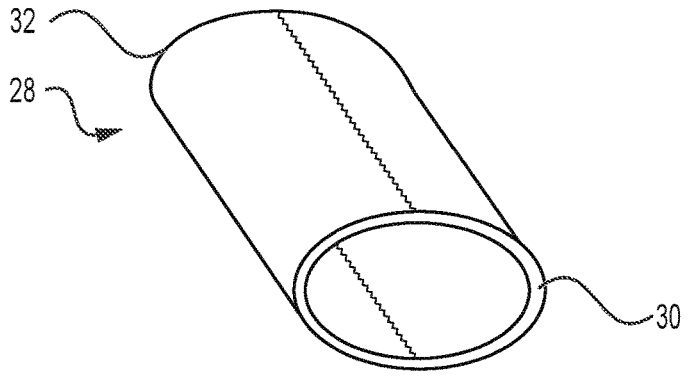
FIG. 7 is a perspective view of a pipe of the reinforced concrete beam with a corrugated web reinforcement plate.

The corrugated plate 10 may have a plurality of openings 16 formed therethrough. As shown in FIG. 5, a plurality of pipes 28 may be received by, and pass through, at least a portion of the plurality of openings 16 formed through the corrugated plate 10. As best seen in FIG. 7, each of the pipes 28 may have a pair of obliquely angled open ends 30, 32.

Although the non-limiting example of FIG. 5 shows steel pipes 28 inserted in the bottom and top rows of openings 16, it should be understood that this arrangement is shown for exemplary purposes only and that pipes 28 may be inserted in any desired rows, columns or other ones of the openings 16. Further, although openings 16 are shown arranged as a regular rectangular grid, it should be understood that any suitable array of openings 16 may be formed through corrugated plate 10. Pipes 28 may be fixed in place by welding or the like. During formation of the reinforced beam 100, the oblique angles of open ends 30, 32 and the orientations of the pipes 28 aid in the flow of concrete within pipes 28 during concreting. This aids both in filling pipes 28 with concrete and permitting the flow of concrete from one side of the corrugated plate 10 to the other.

Returning to FIGS. 1, 2A and 2B, in the non-limiting example shown, the amplitude of the periodic shape of bottom edge 14 is less than the amplitude of the periodic shape of the top edge 12. This allows the total curved length of each of edges 12, 14 to be equal to one another. In this non-limiting example, where the total curved length of each of edges 12, 14 is equal to one another, a rectangular steel sheet will be required for forming the corrugated plate 10. Alternatively, if the curved length at the bottom edge 14 is greater than the curved length of the top edge 12, the sheet used to form the corrugated plate 10 will no longer be rectangular.

In the non-limiting example of FIG. 1, openings 16 are shown as circular openings. If these openings 16 are made after bending the steel plate to make the corrugations, the shape of openings 16 will be circular. However, if a steel plate having circular openings to begin with is used to make the corrugated plate 10, the shapes of the openings post-bending will not be circular. Although circular openings 16 are shown in FIG. 1, it should be understood that a variety of other shapes for the openings may be used, such as, but not limited to, elliptical or polygonal openings.

Figure 3:
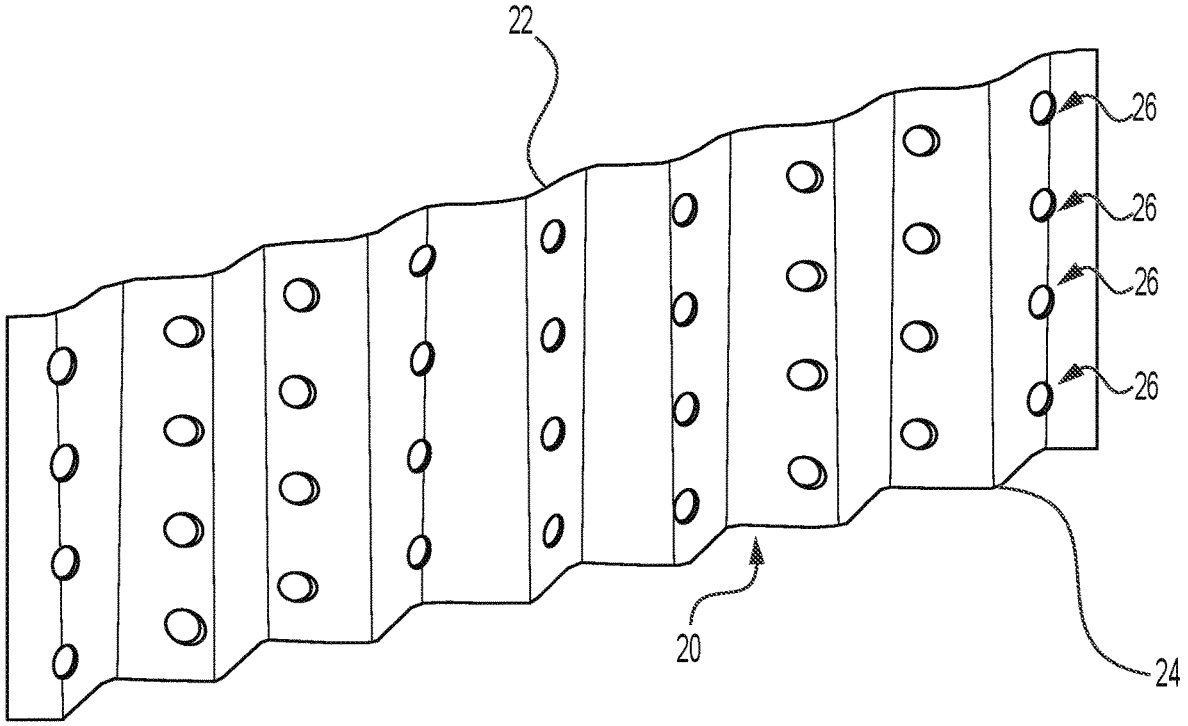
FIG. 3 is a perspective view of an alternative embodiment of the corrugated plate of FIG. 1.
Figure 4A:
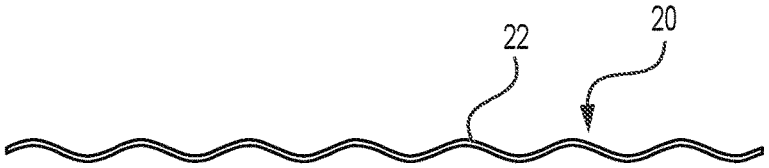
FIG. 4A is a top view of the corrugated plate of FIG. 3.
Figure 4B:
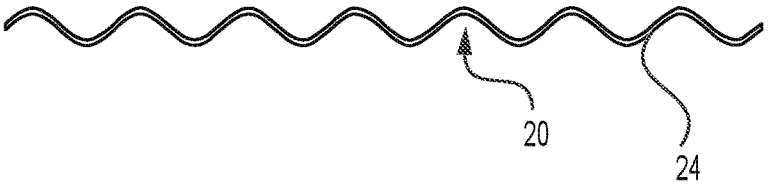
FIG. 4B is a bottom view of the corrugated plate of FIG. 3.

As a further non-limiting example, FIGS. 3, 4A and 4B show a similar corrugated plate 20 with openings 26 formed therethrough. However, the wavelength of the periodic shape of top edge 22 is equal to the wavelength of the periodic shape of bottom edge 24. As shown in FIGS. 4A and 4B, the amplitude of the periodic shape of the bottom edge 24 is greater in this non-limiting example than the amplitude of the periodic shape of the bottom edge 24. It should be understood that contours other than periodic may be used for the corrugations in plates 10 and 20, such as, but not limited to, a Trafford profile.

Figure 6:
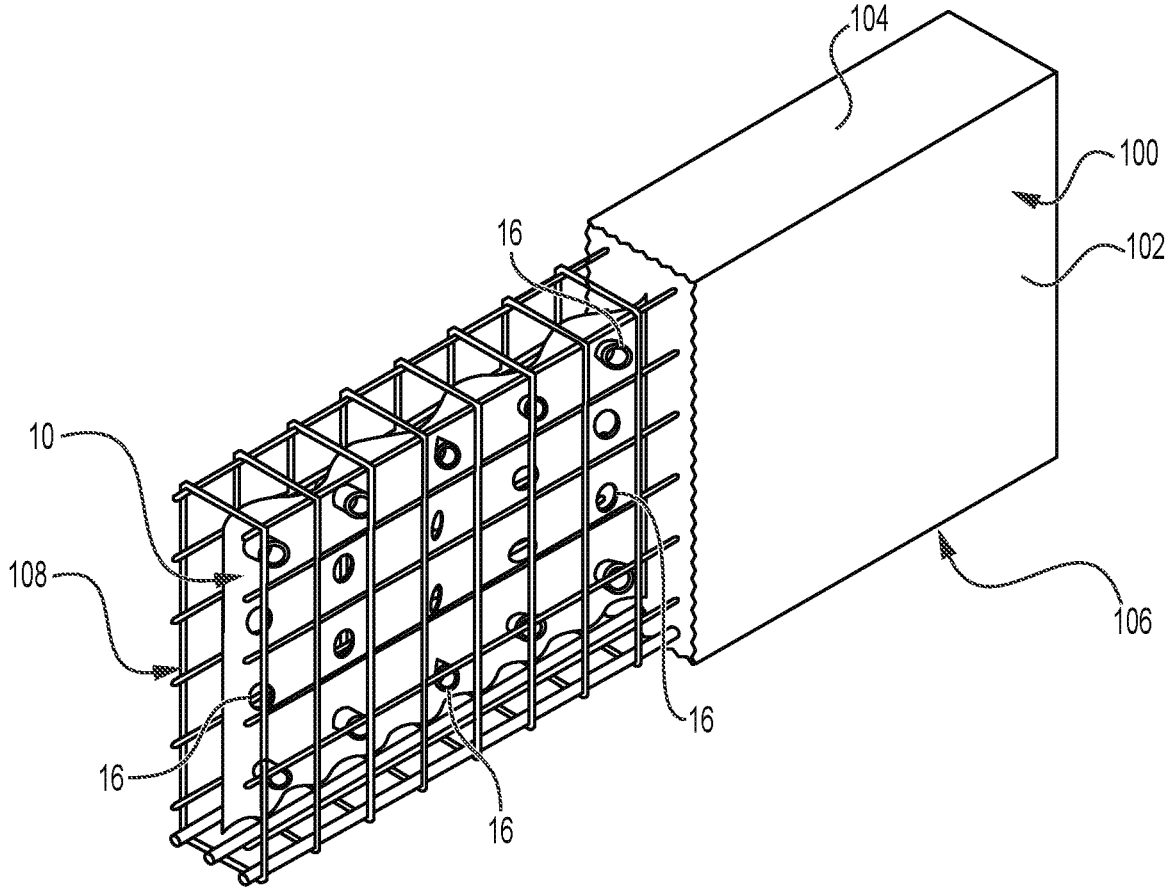
FIG. 6 is partially cut-away perspective view of the reinforced concrete beam with a corrugated web reinforcement plate.

FIG. 6 is partially cut-away perspective view of the reinforced concrete beam with a corrugated web reinforcement plate 100, showing the corrugated plate 10 embedded within concrete beam 102. The openings 16 formed through the corrugated plate 10 provide a good bond with the concrete and permit proper filling and compaction of the concrete by permitting concrete flow through the openings 16 from one side of the plate 10 to the other. The openings 16 are also used for installing pipes 28 which, as discussed above, further enhance the bond and avoid slippage between plate 10 and the concrete 102. It should be understood that the corrugated plate 10 may require additional base plates and/or spacers for maintaining position and alignment during concreting.

As shown in FIG. 6, conventional rebar 108 may also be used in addition to corrugated plate 10. It should be understood that the arrangement of flexural rebar and web reinforcement rebar shown in FIG. 6 is shown for exemplary purposes only. The use of corrugated plate 10 as web reinforcement reduces the requirement for rebar 108 on the two faces of beam 102. The corrugated plate 10 is used as a partial replacement of the web reinforcement 108 because the conventional web reinforcement 108 also provides confinement to the concrete and cannot be eliminated entirely. Although the non-limiting example of FIG. 6 shows corrugated plate 10 embedded in a RC deep beam 102, it should be understood that corrugated plate 10 may also be used as reinforcement in normal shear critical RC beams.

The corrugated plate 10 provides both flexural and shear resistance. The use of a flat embedded steel plate causes slippage between the steel plate and the concrete due to the difference in the flexural and shear stiffnesses of the two. However, the presence of corrugations in corrugated plate 10 makes its initial flexural stiffness comparable with reinforced concrete. This is achieved through proper designing of the corrugated plate 10. As shear cracks start developing, the corrugations begin flattening (i.e., stretching) and, consequently, the flexural and shear stiffness of the embedded steel plate 10 increases. Moreover, the flattening of the corrugations also increases the contribution of plate 10 in resisting flexural and shear deformation. This adds considerable ductility in the shear deformation of RC deep beams, which are otherwise brittle (i.e., non-ductile).

The use of corrugated plate 10 eliminates the use of fibers, which are often used to improve the shear strength of concrete. This is because plate 10 provides considerable shear resistance and controls widening of cracks very effectively. The use of fibers in concrete has numerous drawbacks, including 1) adversely affecting the workability of concrete; 2) increasing the cost because of the inefficient use of fibers; and 3) the distribution of the fibers may not be uniform. Thus, the drawbacks related to the use of steel fibers are obviated by using corrugated plate 10.

Figure 8:
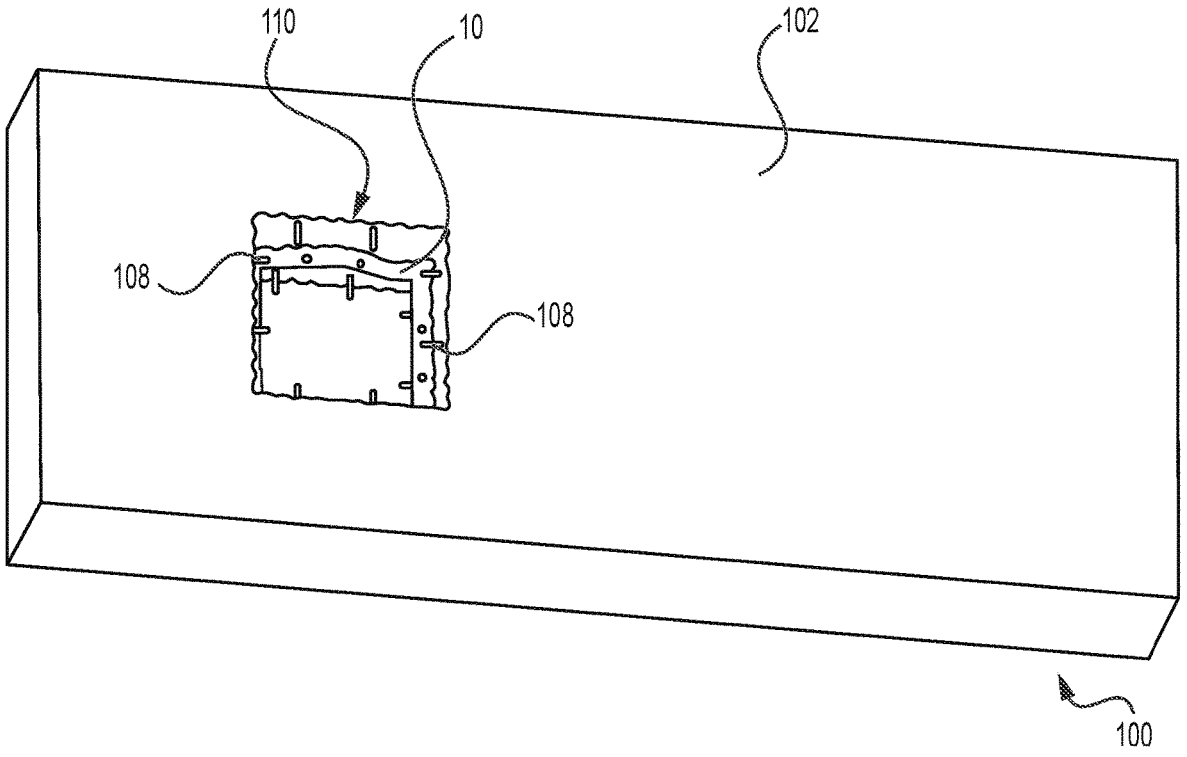
FIG. 8 is a perspective view illustrating a post-construction opening cut through the reinforced concrete beam with a corrugated web reinforcement plate.

In the case of post-construction web openings of different shapes (circular, square, rectangular, elliptical, etc.) being cut into a deep beam, particularly with openings of relatively large size (for which restoring strength by available retrofitting methods is not possible), the loss in strength (particularly the shear strength) of the deep beam can be easily compensated. This is performed by welding and bolting a steel frame of the size of the opening with the corrugated plate 10. In the non-limiting example of FIG. 8, an opening 110 has been cut into concrete beam 102 and through corrugated plate 10. In order to strengthen opening 110, first, two steel frames 112 are prepared for each opening cut through concrete beam 102. In FIG. 8, only a single opening 110 is shown, however, it should be understood that multiple such openings may be formed through a single beam.

Figure 9:
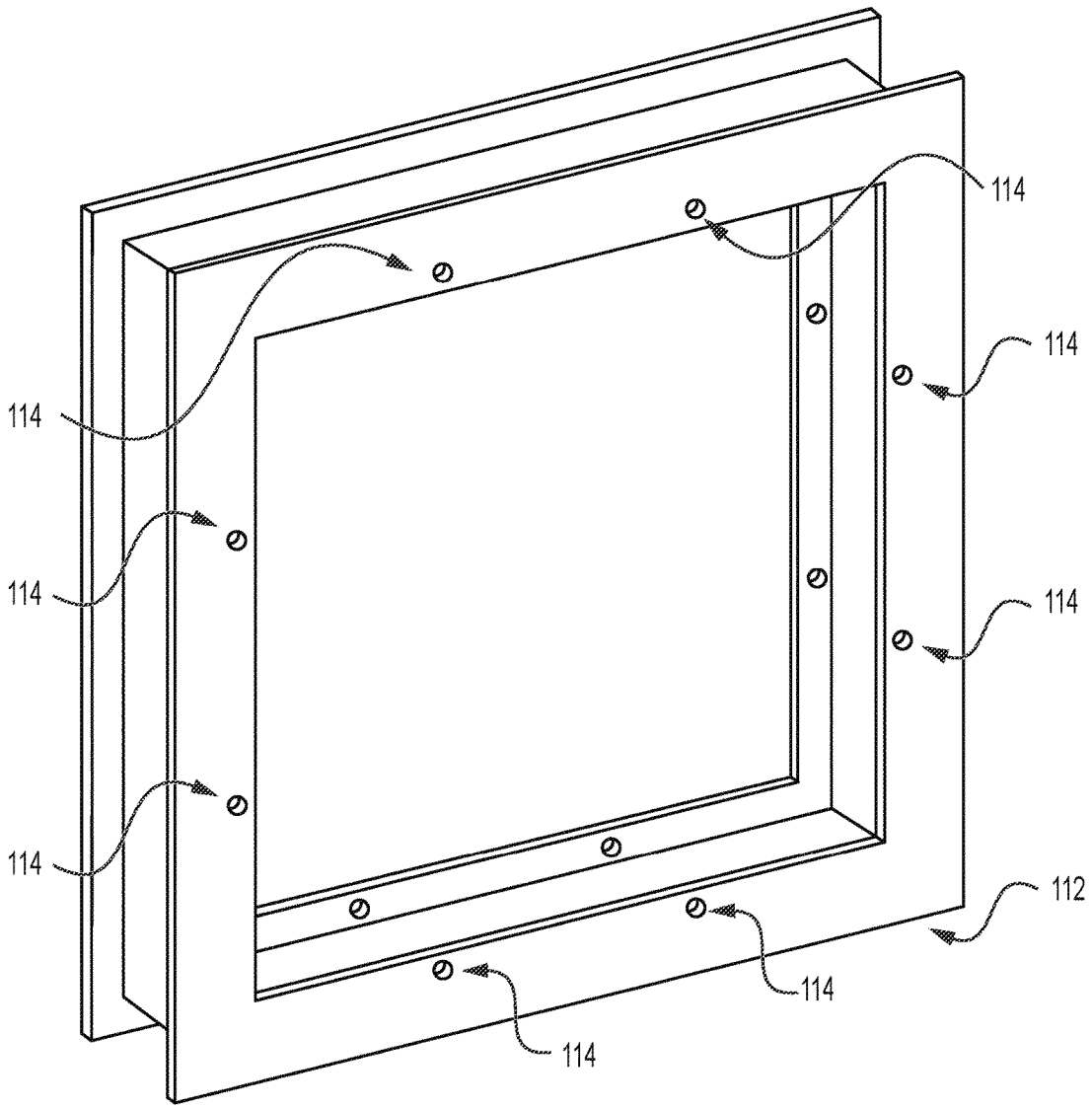
FIG. 9 is a perspective view of a frame for strengthening the post-construction opening of FIG. 8.

For the single opening 110 formed through concrete beam 102 in the non-limiting example of FIG. 8, two frames 112 are prepared. FIG. 9 shows a non-limiting example of one such frame 112. One frame 112 will be fitted from one face of the beam 102 and the other frame 112 will be fitted from the other face of the beam 102. Thus, the depth of each frame 112 should be less than half of the width of the beam 102. The depth of each frame 112 should be equal to $$\left(\frac{b}{2} - c - 2\phi - a\right),$$

where b is the width of beam 102, c is the concrete cover to the web reinforcement, ϕ is the diameter of the rebars 108 used as web reinforcement, and a is the maximum amplitude of the corrugations of the plate 10 at the location of opening 110. The depth of each frame 112 is such that the cut web reinforcement can be welded to the steel frames 112. The frames 112 may be prepared using available rolled steel angle, channel, I-sections or built-up sections. As shown, holes 114 are drilled in the legs of the steel frames 112 for connecting to the embedded corrugated plate 10. The section of each frame 112 is selected based on the design for compensating the loss in strength (flexure and shear) due to the cutting of openings 110 in the deep beam 102.

Figure 10:
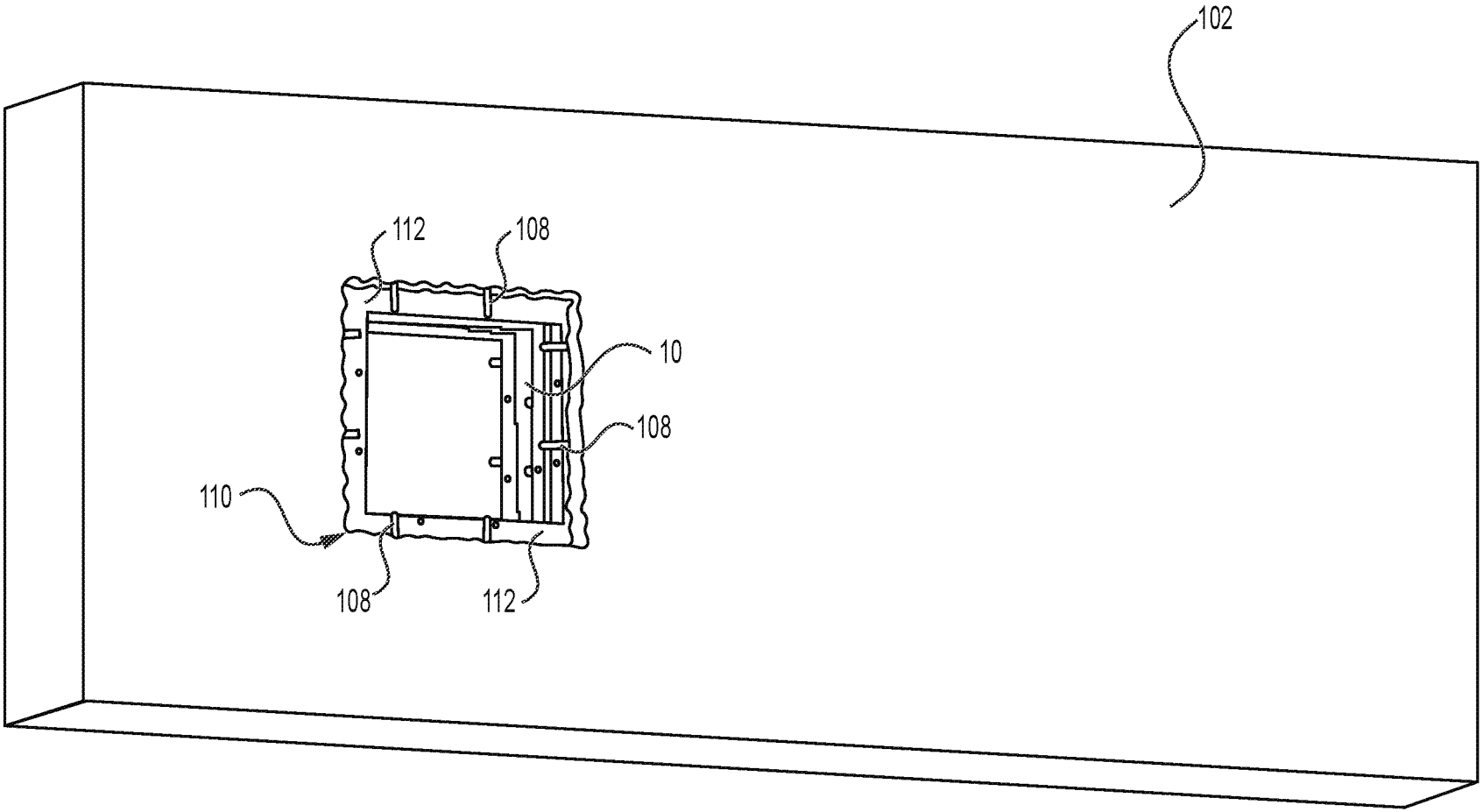
FIG. 10 is a perspective view of the reinforced concrete beam with a corrugated web reinforcement plate of FIG. 8 with a pair of frames installed within the post-construction opening.

The opening(s) 110 are cut to desired size by keeping the beam 102 supported to avoiding its failure during the cutting. Each opening 110 is cut such that the embedded corrugated plate 10 and the web reinforcement are cut to the size of the opening 110, although the cuts made in the concrete 102 should be larger to accommodate the steel frames 112. FIG. 10 shows steel frames 112 applied to opening 110. Although FIGS. 8 and 10 show a square opening 110, it should be understood that an opening having any desired shape may be made and that frames 112 may be contoured and sized appropriately.

The cut rebars 108 should be bent in the plane of the beam depth for making space for fixing the steel frames 112. All rebars 108 are not required to be bent. As shown in FIG. 8, matching holes are drilled in the embedded corrugated plate 10 at locations corresponding to those in the steel frames 112 for connecting the steel frames 112 with plate 10 using bolts. As shown in FIG. 10, the steel frames 112 are placed in opening 110 and are connected to the corrugated plate 10 by tightening the bolts. The bolts may be provided either on the inner or both connected legs (i.e., both inner and outer) of the steel frame 112. The access to the bolts on the outer connected leg of the frame 112 will require cutting extra concrete. The frames 112 are then welded to corrugated plate 10. Due to the corrugations in the embedded plate 10, the welding of the frames 112 thereto may require some packing steel flats/rebars for insertion between the frames 112 and the corrugations of plate 10.

The web reinforcement bars 108 are then restraightened and welded to the steel frames 112. The gaps between the frames 112 and the concrete of beam 102 may be filled using non-shrink concrete, grout or the like. The connection of the steel frames 112 with the embedded corrugated steel plate 10 provides sufficient anchorage of each frame 112 with the RC deep beam 102. Thus, the use of anchors, which are difficult to install, may be avoided. The welding of web rebars 108 with the frames 112 also provides additional anchorage of each frame 112 with the RC deep beam 102.

It is to be understood that the reinforced concrete beam with a corrugated web reinforcement plate is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A reinforced concrete beam with a corrugated web reinforcement plate, comprising:

a concrete beam; and a corrugated plate embedded in the concrete beam, wherein the corrugated plate has a top edge with a periodic shape and a bottom edge with a periodic shape, wherein the periodic shape of the top edge has a larger wavelength than a wavelength of the periodic shape of the bottom edge.

2. The reinforced concrete beam with a corrugated web reinforcement plate as recited in claim 1, wherein the corrugated plate has a plurality of openings formed therethrough.

3. The reinforced concrete beam with a corrugated web reinforcement plate as recited in claim 2, further comprising a plurality of pipes received by and passing through at least a portion of the plurality of openings formed through the corrugated plate.

4. The reinforced concrete beam with a corrugated web reinforcement plate as recited in claim 3, wherein each of the pipes has a pair of obliquely angled open ends.

5. The reinforced concrete beam with a corrugated web reinforcement plate as recited in claim 1, wherein the wavelength of the periodic shape of the bottom edge is between 25% and 75% of the wavelength of the periodic shape of the top edge.

6. The reinforced concrete beam with a corrugated web reinforcement plate as recited in claim 1, wherein the wavelength of the periodic shape of the bottom edge is 50% of the wavelength of the periodic shape of the top edge.

7. The reinforced concrete beam with a corrugated web reinforcement plate as recited in claim 1, further comprising rebars embedded in the concrete beam.

8. The reinforced concrete beam with a corrugated web reinforcement plate as recited in claim 1, wherein an amplitude of the periodic shape of the bottom edge is less than an amplitude of the periodic shape of the top edge.

9. A reinforced concrete beam with a corrugated web reinforcement plate, comprising:

a concrete beam; and a corrugated plate embedded in the concrete beam, wherein the corrugated plate has a top edge with a periodic shape and a bottom edge with a periodic shape, wherein the periodic shape of the top edge has a wavelength equal to a wavelength of the periodic shape of the bottom edge, wherein an amplitude of the periodic shape of the bottom edge is greater than an amplitude of the periodic shape of the top edge.

10. The reinforced concrete beam with a corrugated web reinforcement plate as recited in claim 9, wherein the corrugated plate has a plurality of openings formed therethrough.

11. The reinforced concrete beam with a corrugated web reinforcement plate as recited in claim 10, further comprising a plurality of pipes received by and passing through at least a portion of the plurality of openings formed through the corrugated plate.

12. The reinforced concrete beam with a corrugated web reinforcement plate as recited in claim 11, wherein each of the pipes has a pair of obliquely angled open ends.

13. The reinforced concrete beam with a corrugated web reinforcement plate as recited in claim 9, further comprising rebars embedded in the concrete beam.

* * * * *